US006634180B2

(12) United States Patent
Yim

(10) Patent No.: US 6,634,180 B2
(45) Date of Patent: Oct. 21, 2003

(54) SYSTEM AND METHOD FOR DEFROST TERMINATION FEEDBACK

(75) Inventor: Dong-Joon Yim, Anyang (KR)

(73) Assignee: Carrier Corporation, Farmington, CT (US)

( * ) Notice: Subject to any disclaimer, the term of this patent is extended or adjusted under 35 U.S.C. 154(b) by 99 days.

(21) Appl. No.: 10/005,109

(22) Filed: Dec. 5, 2001

(65) Prior Publication Data

US 2003/0101738 A1 Jun. 5, 2003

(51) Int. Cl.[7] ..... F25B 47/02
(52) U.S. Cl. ..... 62/156; 62/324.5
(58) Field of Search ..... 62/151, 154, 155, 62/156, 234, 298, 324.1, 324.5, 160, 140, 81, 277, 278

(56) References Cited

U.S. PATENT DOCUMENTS 3,400,553 A * 9/1968 Orbesen ..... 62/160 X
3,461,681 A * 8/1969 Smith et al. ..... 62/81
3,466,888 A * 9/1969 Kyle ..... 62/156
4,373,350 A * 2/1983 Noland ..... 62/156
4,439,995 A * 4/1984 McCarty ..... 62/156

* cited by examiner

*Primary Examiner*—Harry B. Tanner
(74) *Attorney, Agent, or Firm*—Wall Marjama & Bilinski LLP

(57) ABSTRACT

A heat pump system includes an indoor unit and an outdoor unit, with a compressor, an outdoor fan, and a reversing valve all in the outdoor unit. A thermostat is added to the outdoor unit with one side of the thermostat connected to a high voltage line for either a compressor or a magnetic contactor and the other side connected to a high voltage line for either an outdoor fan or a reversing valve. A signal collection circuit in the indoor unit is connected to a high voltage line for the outdoor fan when the other side of the thermostat is connected to the outdoor fan and to a high voltage line for the reversing valve when the other side of the thermostat is connected to the reversing valve. The thermostat sends a signal to the electronic control board when the defrosting operation should be terminated.

3 Claims, 5 Drawing Sheets

SYSTEM AND METHOD FOR DEFROST TERMINATION FEEDBACK

FIELD OF THE INVENTION

This invention relates generally to the field of heat pumps, and more particularly to a fixed-speed duct-free split heat pump unit.

BACKGROUND OF THE INVENTION

Heat pump systems use a refrigerant to carry thermal energy between a relatively hotter side of a circulation loop to a relatively cooler side of the circulation loop. Compression of the refrigerant occurs at the hotter side of the loop, where a compressor raises the temperature of the refrigerant. Evaporation of the refrigerant occurs at the cooler side of the loop, where the refrigerant is allowed to expand, thus resulting in a temperature drop. Thermal energy is added to the refrigerant on one side of the loop and extracted from the refrigerant on the other side, due to the temperature differences between the refrigerant and the indoor and outdoor mediums, respectively, to make use of the outdoor mediums as either a thermal energy source or a thermal energy sink. In the case of an air to water heat pump, outdoor air is used as a thermal energy source while water is used as a thermal energy sink.

The process is reversible, so the heat pump can be used for either heating or cooling. Residential heating and cooling units are bidirectional, in that suitable valve and control arrangements selectively direct the refrigerant through indoor and outdoor heat exchangers so that the indoor heat exchanger is on the hot side of the refrigerant circulation loop for heating and on the cool side for cooling. A circulation fan passes indoor air over the indoor heat exchanger and through ducts leading to the indoor space. Return ducts extract air from the indoor space and bring the air back to the indoor heat exchanger. A fan likewise passes ambient air over the outdoor heat exchanger, and releases heat into the open air, or extracts available heat therefrom.

These types of heat pump systems operate only if there is an adequate temperature difference between the refrigerant and the air at the respective heat exchanger to maintain a transfer of thermal energy. For heating, the heat pump system is efficient provided the temperature difference between the air and the refrigerant is such that the available thermal energy is greater than the electrical energy needed to operate the compressor and the respective fans. For cooling, the temperature difference between the air and the refrigerant generally is sufficient, even on hot days.

Under certain operating conditions, frost builds up on a coil of the heat pump. The speed of the frost build-up is strongly dependent on the ambient temperature and the humidity ratio. Coil frosting results in lower coil efficiency while affecting the overall performance (heating capacity and coefficient of performance (COP)) of the unit. From time to time, the coil must be defrosted to improve the unit efficiency. In most cases, coil defrosting is achieved through refrigerant cycle inversion. The time during which the coil defrosting occurs impacts the overall efficiency of the unit, since the hot refrigerant in the unit, which provides the desired heat, is actually cooled during coil defrosting.

In a fixed-speed duct-free split heat pump unit that doesn't have an electronic control device board on the outdoor unit, the defrost operation which eliminates the frost accumulated on the outdoor heat exchanger during heating operation requires feedback from the outdoor unit to the indoor unit to terminate the defrost operation.

Referring to FIG. 1, in the prior art of defrost termination detection feedback, a low voltage sensor 10 is needed for the outdoor heat exchanger temperature detection. This requires two low voltage lines of interconnection wires 14, 16 to connect sensor 10 to an indoor electronic control 12.

Referring to FIG. 2, when a high voltage thermostat 18 is used to detect the outdoor heat exchanger temperature, an additional high voltage interconnection wire 20 is needed for the feedback to indoor electronic control 12.

Referring to FIG. 3, a system which uses an outdoor sensorless defrost algorithm includes a current transformer 22 on indoor electronic control 12 to measure current flows through a compressor 24 to detect the defrost termination point. When the heat pump unit is too large to use a power relay on indoor electronic control 12, a magnetic contactor 26 is used to turn compressor 24 on and off. There is then a need for an additional high voltage interconnection wire 28 to make the compressor current flow through the current transformer loop on indoor electronic control 12.

SUMMARY OF THE INVENTION

Briefly stated, a heat pump system includes an indoor unit and an outdoor unit, with a compressor, an outdoor fan, and a reversing valve all in the outdoor unit. A thermostat is added to the outdoor unit with one side of the thermostat connected to a high voltage line for either a compressor or a magnetic contactor and the other side connected to a high voltage line for either an outdoor fan or a reversing valve. A signal collection circuit in the indoor unit is connected to a high voltage line for the outdoor fan when the other side of the thermostat is connected to the outdoor fan and to a high voltage line for the reversing valve when the other side of the thermostat is connected to the reversing valve. The thermostat sends a signal to the electronic control board when the defrosting operation should be terminated.

According to an embodiment of the invention, a heat pump system includes an indoor unit and an outdoor unit, along with a compressor, an outdoor fan, and a reversing valve all in the outdoor unit; a thermostat in the outdoor unit; a first side of the thermostat connected to a high voltage line for one of a compressor and a magnetic contactor and a second side of the thermostat connected to a high voltage line for one of an outdoor fan and a reversing valve; and a signal collection circuit in the indoor unit connected to a high voltage line for the outdoor fan when the second side of the thermostat is connected to the outdoor fan and to a high voltage line for the reversing valve when the second side of the thermostat is connected to the reversing valve.

According to an embodiment of the invention, a method for terminating a defrost operation in a heat pump system having an indoor unit and an outdoor unit includes the steps of connecting, in the outdoor unit, a first side of a thermostat between a high voltage line for one of a compressor and a magnetic contactor and connecting a second side of the thermostat to a high voltage line for one of an outdoor fan and a reversing valve; connecting, in the indoor unit, a signal collection circuit to a high voltage line for the outdoor fan when the second side of the thermostat is connected to the outdoor fan, and to a high voltage line for the reversing valve when the second side of the thermostat is connected to the reversing valve; and terminating the defrost operation when the thermostat is activated upon reaching a predetermined temperature.

DETAILED DESCRIPTION OF THE PREFERRED EMBODIMENT

Figure 4:
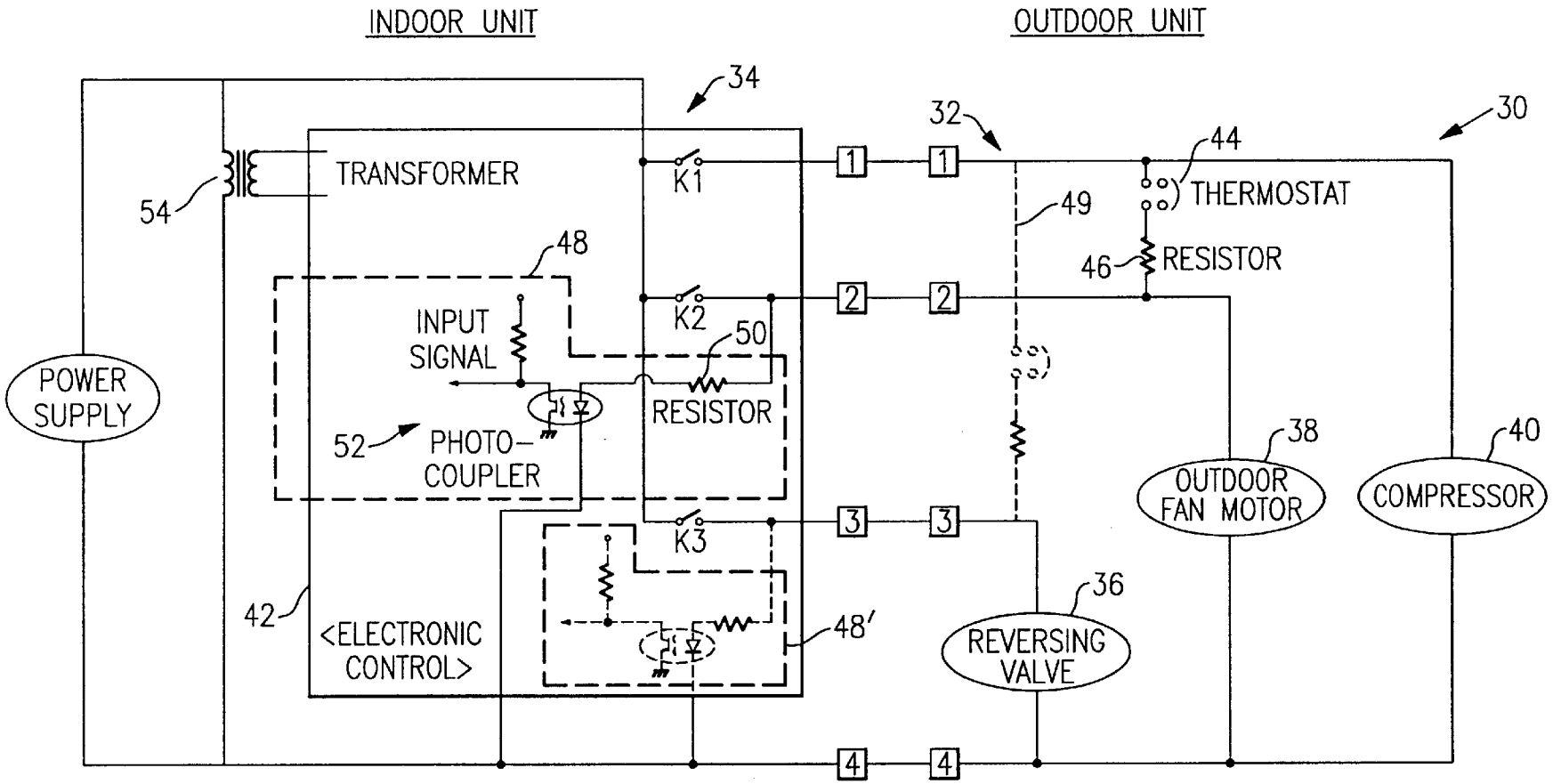
FIG. 4 shows a system equipped with defrost termination feedback according to an embodiment of the invention.

Referring to FIG. 4, a heat pump system 30 includes an outdoor unit 32 and an indoor unit 34. The initiation of the defrost operation is decided by a temperature delta calculation equation based on conventional inputs. Once the normal defrost cycle is initiated, then a reversing valve 36 changes it status to OFF, an outdoor fan 38 turns OFF, and a compressor 40 is running. The outdoor coil then becomes warmer so that the frost accumulated on the outdoor coil is melted and drained away. However, the outdoor coil temperature is too hot after the frost is completely melted, causing the over load protector (OLP) of compressor 40 to become activated to cut off the power to the compressor motor. Once the OLP is activated, it takes several tens of minutes for compressor 40 to turn back on. The present invention prevents the activation of the OLP of compressor 40 by using a thermostat to signal an indoor electronic control 42 to cut off the power to compressor 40 when the thermostat indicates an outdoor coil temperature of a predetermined temperature, preferably between 15 to 40 degrees C.

A relay K1 controls compressor 40, a relay K2 controls outdoor fan 38, and relay K3 controls reversing valve 36. A transformer 54 is a step down transformer for the low voltage power supply for indoor electronic control 42.

A high voltage thermostat 44 and a resistor 46 in outdoor unit 32 are connected in series between the high voltage lines for compressor 40 and outdoor fan 38, or alternately between the high voltage lines for compressor 40 and reversing valve 36 as shown by a connection 49. Thermostat 44 detects the temperature at the outdoor heat exchanger. The signal from thermostat 44 is then received from the high voltage line for outdoor fan 38 by a signal collection circuit 48, or alternately from the high voltage line for reversing valve 36 by a signal collection circuit 48'. Signal collection circuit 48 preferably includes a resistor 50 connecting a photo-coupler 52 to the high voltage line for outdoor fan 38. An input signal is derived from photo-coupler 52, which signal is an input to indoor electronic control 42. Photo-coupler 52 converts the signal from a high voltage signal to a low voltage signal. Signal collection circuit 48', which is the same as signal collection circuit 48, is used instead of signal collection circuit 48 when thermostat 44 is connected using connection 49. Signal collection circuit 48' therefore connects to the high voltage line for reversing valve 36 instead of to the high voltage line for outdoor fan 38.

Thus the wires which already exist for the compressor 40 and outdoor fan 38 (or reversing valve 36) line connections between indoor unit 34 and outdoor unit 32 are used to complete the feedback loop, while signal collection circuit 48 converts the signal from high voltage to low voltage for use by electronic control 42. There is thus no need for an additional interconnection wire for this feedback.

Resistors 46 and 50 are preferably 30 K resistors rated at 5 W. Since the value of resistor 46 is several tens of kilo-ohms, compressor 40 and outdoor fan 38 cannot be run even though power is supplied to compressor 40 and outdoor fan 38 through this resistor 46.

Figure 1:
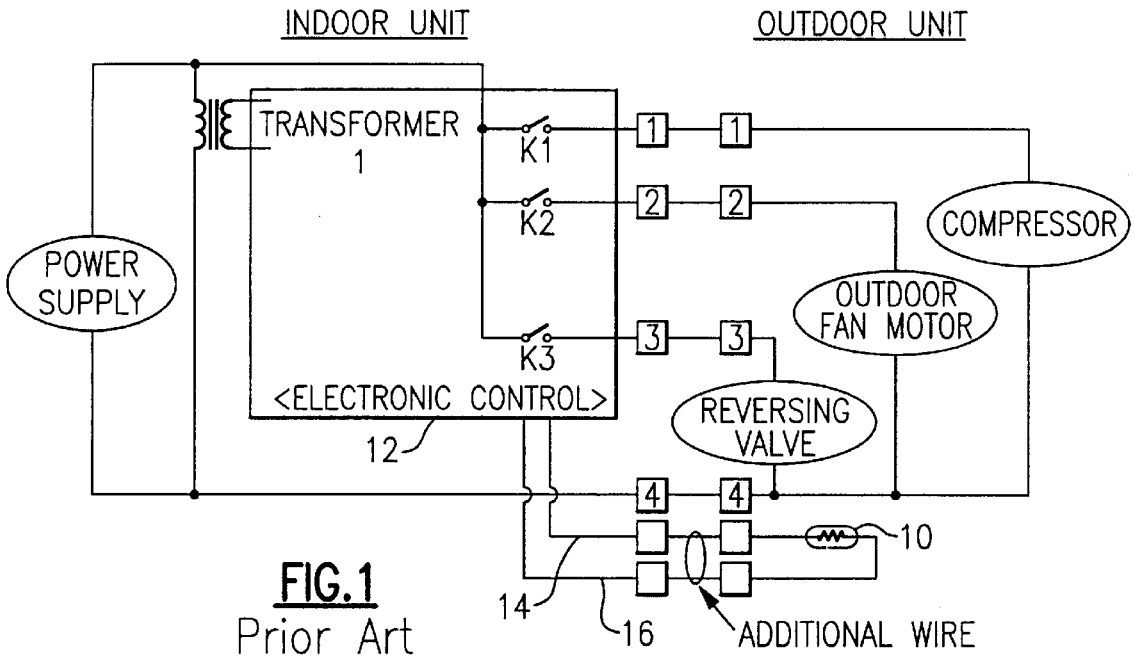
FIG.1 Prior Art
FIG. 1 shows a system equipped with defrost termination detection feedback according to the prior art.
Figure 2:
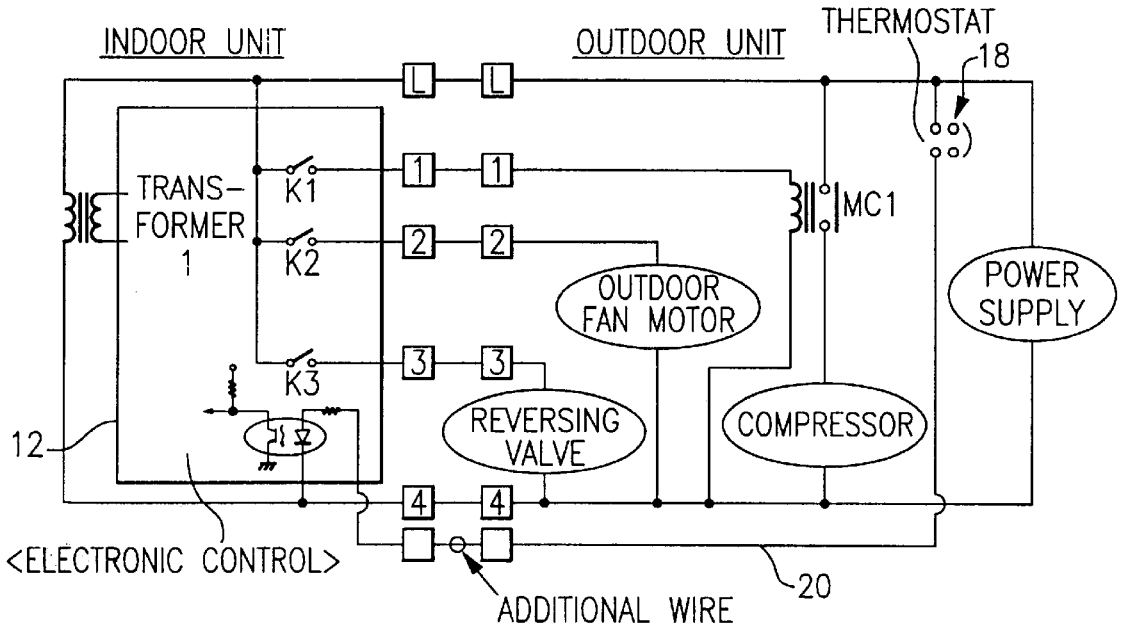
FIG.2 Prior Art
FIG. 2 shows a system equipped with defrost termination detection feedback according to the prior art.
Figure 3:
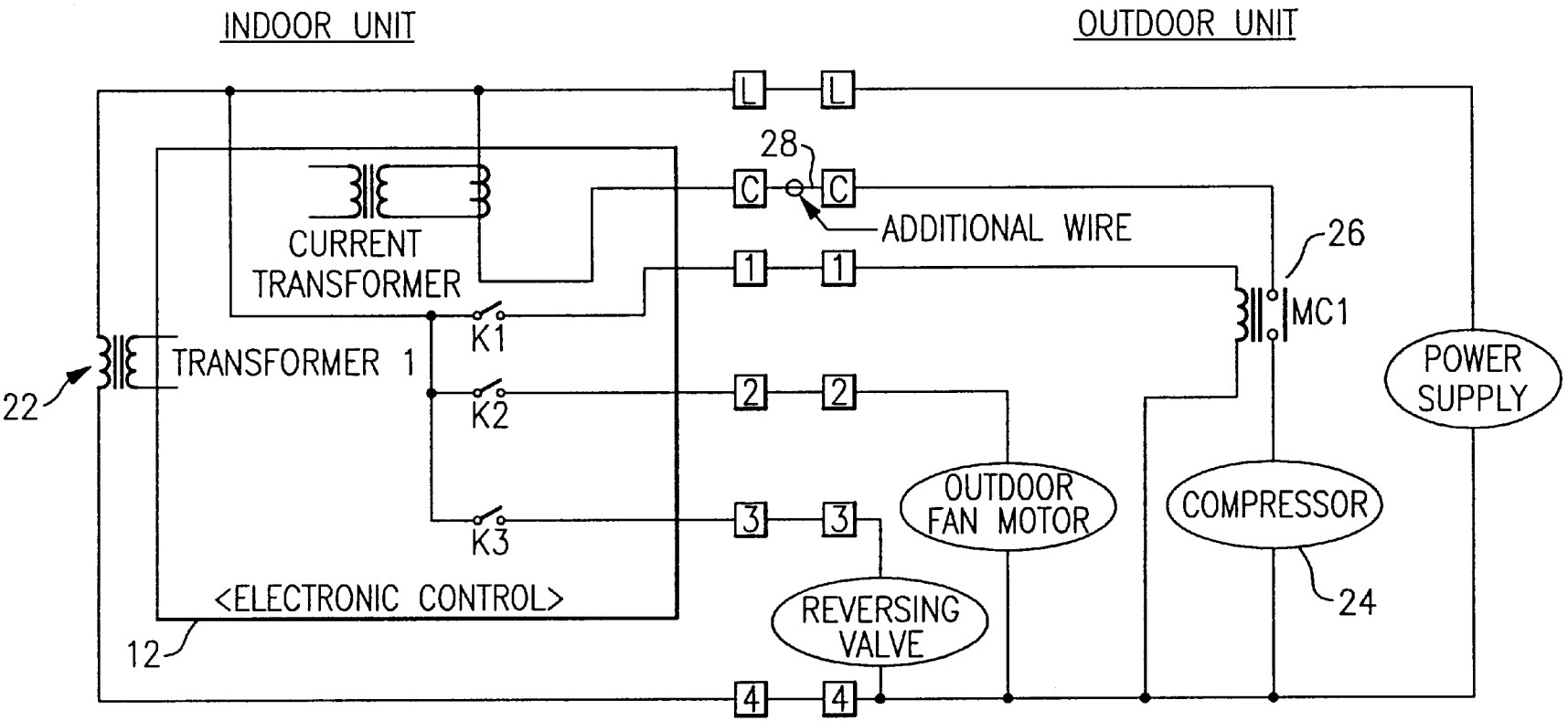
FIG.3 Prior Art
FIG. 3 shows a system equipped with defrost termination detection feedback according to the prior art.
Figure 5:
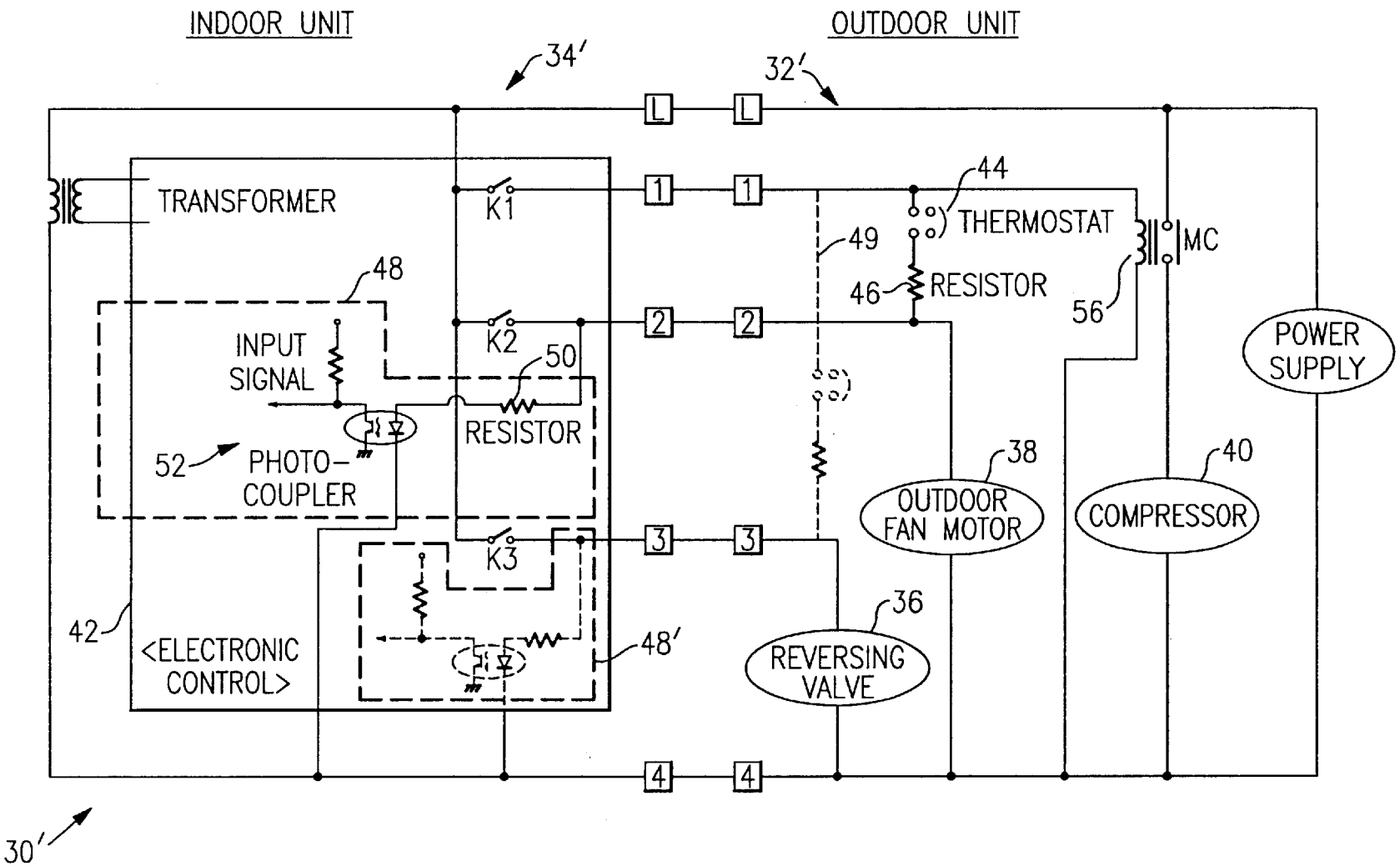
FIG. 5 shows a system equipped with defrost termination feedback according to an embodiment of the invention.

Referring to FIG. 5, a heat pump system 30' is shown which is similar to the prior art system of FIG. 3. When thermostat 44 is connected between the high voltage line for a magnetic contactor 56 and the high voltage line for outdoor fan 38, signal collection circuit 48 is used. When thermostat 44 is connected between the high voltage line for magnetic contactor 56 and the high voltage line for reversing valve 36, signal collection circuit 48' is used.

Figure 6:
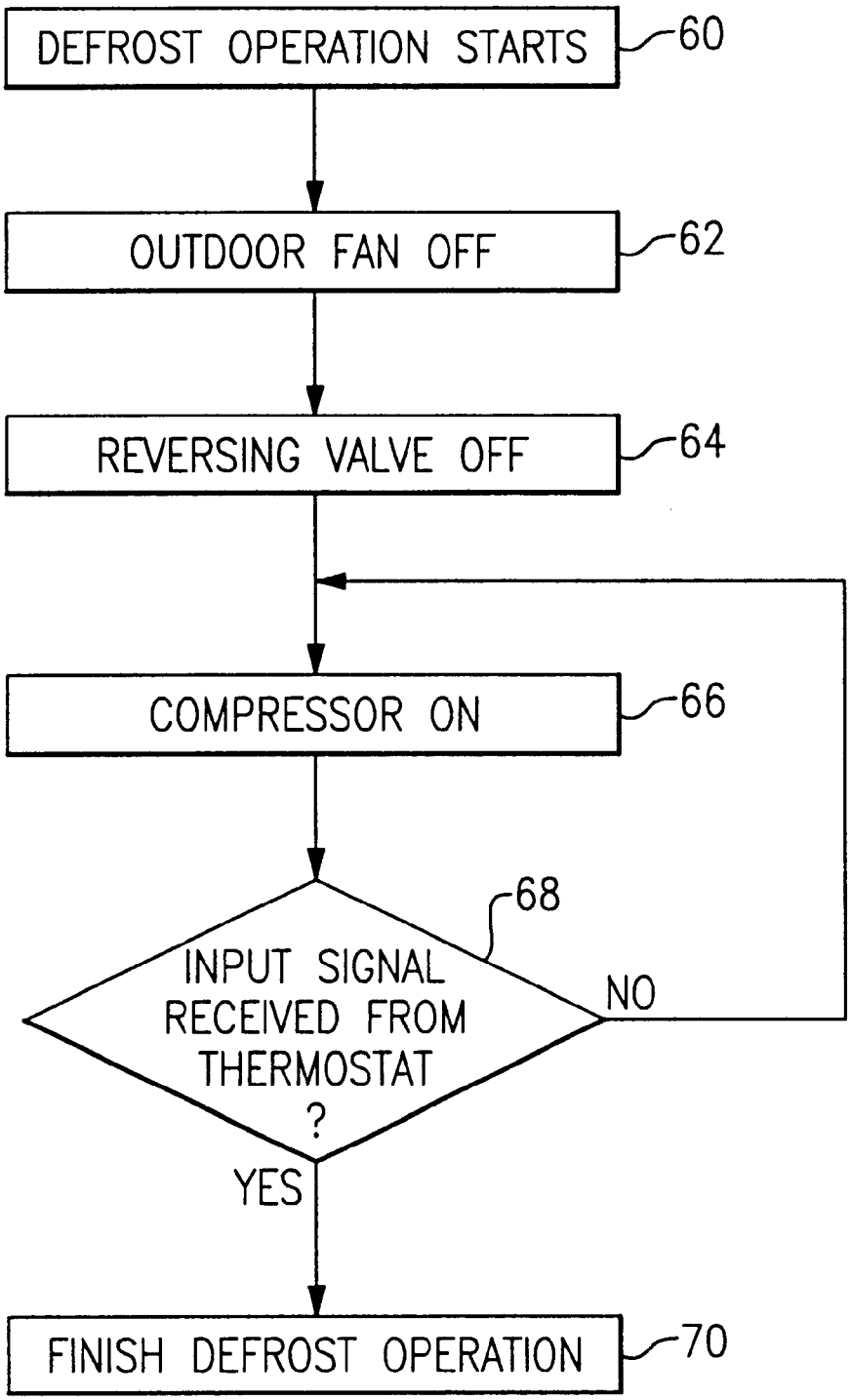
FIG. 6 shows a method of defrost termination used with the embodiments of FIGS. 4 and 5.

Referring to FIG. 6, the method to finish the defrost operation using the above device is as follows. The defrost operation begins in step 60. During the defrost operation, outdoor fan 38 is turned off via relay K2 in step 62, while reversing valve 36 is turned off in step 64, i.e., reversing valve 36 is in the cooling position, typically accomplished by turning relay K3 off. AS shown in step 66, only compressor 40 is running, i.e., relay K1 is ON. While compressor 40 is running, thermostat 44 is activated according to the temperature changes of the outdoor heat exchanger. If the input signal is not received from thermostat 44 in step 68, the compressor remains on in step 66. When the input signal is received from thermostat 44, i.e., thermostat 44 is activated, this activation is transferred as the input signal to indoor electronic control 42 as explained above. Indoor electronic control 42 terminates the defrost operation according to this feedback signal in step 70.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A heat pump system including an indoor unit and an outdoor unit, comprising:

a compressor, an outdoor fan, and a reversing valve all in said outdoor unit;

a thermostat in said outdoor unit;

a first side of said thermostat connected to a high voltage line for one of a compressor and a magnetic contactor and a second side of said thermostat connected to a high voltage line for one of an outdoor fan and a reversing valve; and a signal collection circuit in said indoor unit connected to a high voltage line for said outdoor fan when said second side of said thermostat is connected to said outdoor fan and to a high voltage line for said reversing valve when said second side of said thermostat is connected to said reversing valve.

2. A system according to claim 1, further comprising termination means for terminating a defrost operation of said outdoor unit, wherein said thermostat activates upon reaching a predetermined temperature and signals said termination means to end said defrost operation.

3. A method for terminating a defrost operation in a heat pump system having an indoor unit and an outdoor unit, comprising the steps of:

connecting, in said outdoor unit, a first side of a thermostat between a high voltage line for one of a compressor and a magnetic contactor and connecting a second side of said thermostat to a high voltage line for one of an outdoor fan and a reversing valve;

connecting, in said indoor unit, a signal collection circuit to a high voltage line for said outdoor fan when said second side of said thermostat is connected to said outdoor fan, and to a high voltage line for said reversing valve when said second side of said thermostat is connected to said reversing valve; and terminating said defrost operation when said thermostat is activated upon reaching a predetermined temperature.

* * * * *